US011097142B2

(12) United States Patent
Shouhed

(10) Patent No.: US 11,097,142 B2
(45) Date of Patent: Aug. 24, 2021

(54) EXERCISE DEVICE

(71) Applicant: Rebecca Shouhed, San Fernando, CA (US)

(72) Inventor: Rebecca Shouhed, San Fernando, CA (US)

( * ) Notice: Subject to any disclaimer, the term of this patent is extended or adjusted under 35 U.S.C. 154(b) by 51 days.

(21) Appl. No.: 16/424,278

(22) Filed: May 28, 2019

(65) Prior Publication Data

US 2020/0376316 A1 Dec. 3, 2020

(51) Int. Cl.

| | |
|---|---|
| ***A63B 21/00*** | (2006.01) |
| ***A63B 23/04*** | (2006.01) |
| ***A63B 21/055*** | (2006.01) |
| ***A63B 21/04*** | (2006.01) |

(52) U.S. Cl.

CPC .... *A63B 21/00043* (2013.01); *A63B 21/0428* (2013.01); *A63B 21/0557* (2013.01); *A63B 21/4015* (2015.10); *A63B 23/0488* (2013.01); *A63B 23/0494* (2013.01)

(58) Field of Classification Search

CPC ..... A63B 21/00043; A63B 23/0494; A63B 21/4015; A63B 21/0428; A63B 23/0488; A63B 21/0557; A63B 21/02; A63B 21/055–0557; A63B 21/4011–4015; A63B 2208/0219; A63B 2208/0223–0233; A63B 2208/0242–0257

See application file for complete search history.

(56) References Cited

U.S. PATENT DOCUMENTS

| | | | | |
|---|---|---|---|---|
| 3,411,500 A * | 11/1968 | James | B64G 7/00 600/20 |
| 5,203,754 A * | 4/1993 | Maclean | A63B 21/0004 482/121 |
| 6,099,446 A * | 8/2000 | Johnson | A63B 21/0004 482/124 |
| 7,087,003 B1 * | 8/2006 | Katterjohn | A63B 21/0004 482/124 |

(Continued)

OTHER PUBLICATIONS

Healthline (derived from: Peggy Pletcher, "Donkey Kick Exercises: Get Your Booty in Gear" [online], Dec. 18, 2016 [retrieved on Sep. 5, 2020], Healthline, Retrieved from: https://www.healthline.com/health/fitness-exercise/donkey-kick) (Year: 2016).*

(Continued)

*Primary Examiner* — Jennifer Robertson
*Assistant Examiner* — Catrina A Letterman
(74) *Attorney, Agent, or Firm* — Kelly & Kelley, LLP

(57) ABSTRACT

The exercise device of the present invention has a first assembly with a first strap configured to encircle a user's first bodily appendage, such as a thigh or a foot, with the first strap having a first attachment ring. The exercise device also has a second assembly with a second strap configured to encircle a user's second bodily appendage, such as a foot, with the second strap having a plurality of second attachment rings. The exercise device also has one or more elastic resistance bands configured for connecting at one end to the first attachment ring and at an opposite second end to one of the plurality of second attachment rings. Exercises with the (Continued)

device have the user moving between starting positions and finishing positions against the resistance of the bands.

9 Claims, 14 Drawing Sheets

(56) References Cited

U.S. PATENT DOCUMENTS

| | | | | |
|---|---|---|---|---|
| 7,261,679 | B2 * | 8/2007 | Sload | A63B 21/4015 482/124 |
| 9,629,405 | B2 * | 4/2017 | Cornish | A63B 21/4015 |
| 9,764,180 | B2 * | 9/2017 | Bybee | A63B 23/03575 |
| 2003/0045408 | A1 * | 3/2003 | Seles | A63B 23/03525 482/121 |
| 2004/0137998 | A1 * | 7/2004 | Perry | A63B 69/3667 473/270 |
| 2005/0192168 | A1 * | 9/2005 | Wilcocks | A63B 21/0552 482/124 |
| 2012/0232449 | A1 * | 9/2012 | Arnstein | A63B 23/085 602/16 |
| 2012/0258844 | A1 * | 10/2012 | Petrone | A63B 21/00061 482/124 |
| 2013/0231227 | A1 * | 9/2013 | Ranieri | A63B 21/00061 482/124 |
| 2016/0129294 | A1 * | 5/2016 | Gillespie | A63B 21/0555 482/124 |
| 2017/0135837 | A1 * | 5/2017 | Jara | A61F 5/3715 |
| 2019/0201731 | A1 * | 7/2019 | Nguyen | A63B 21/00065 |

OTHER PUBLICATIONS

STACK.com (derived from: Andy Haley, "How the Fire Hydrant Exercise Can Improve Your Performance" [online], Oct. 31, 2012 [retrieved on Sep. 5, 2020], Stack, Retrieved from: https://www.stack.com/a/fire-hydrants) (Year: 2012).*

Canadian Sport Institute Pacific (derived from: Canadian Sport Institute Pacific, "Weighted Single Leg Squat to Box" [online], Sep. 11, 2018 [retrieved on Sep. 5, 2020], Youtube, Retrieved from: https://www.youtube.com/watch?v=FnQNJtl3jbE) (Year: 2018).*

MelioGuide (derived from: Margaret Martin, "Alternating Leg Lifts Prone" [online], Apr. 7, 2016 [retrieved on Sep. 5, 2020], MelioGuide, Retrieved from: https://melioguide.com/osteoporosis-exercises/alternating-leg-lifts/) (Year: 2016).*

Men's Health (derived from: Men's Health, "Miniband Bicycle Crunch" [online], Sep. 7, 2016 [retrieved on Sep. 5, 2020] , Youtube, Retrieved from: https://www.youtube.com/watch?v=i5hJzH1AhRw) (Year: 2016).*

Fit Together Personal Training (derived from: Fit Together Personal Training, "Band Sumo Walk" [online], Jul. 28, 2015 [retrieved on Sep. 5, 2020], Youtube, Retrieved from: https://www.youtube.com/watch?v=fGP4QQ0URqM) (Year: 2015).*

* cited by examiner

EXERCISE DEVICE

BACKGROUND OF THE INVENTION

The present invention is directed to an exercise device. More particularly, the present invention is directed to a resistance band exercise device specifically to exercise leg and lower body muscles.

There are many exercises and devices that target leg and lower body muscles, particularly gluteal muscles. For fitness enthusiasts and those that want to target gluteal muscles, such exercises often involve various devices.

Various prior art methods to perform similar exercise movements were "makeshift" exercises. Once such exercise involved placing a dumbbell behind the knee joint, which is not stable and can result in injury. Another exercise involves using a linear resistance band, which is also not safe because the band could slip off from either leg causing a sudden jerking movement or injury to the user. Another such exercise involves the use of heavy ankle weights, e.g., approximately 40 pounds, in a kickback move, which distributes resistance to other muscle groups, thereby not as easily activating the targeted muscle group to its fullest potential.

In certain areas or regions, it is often difficult to obtain ankle weights with sufficient mass. One way of overcoming the limitation on finding ankles weights with the desired mass is to obtain multiple ankle weights of lower mass and wear them on the same ankle. Such multiple ankle weights may be difficult to reliably secure onto a single ankle or create additional steps in switching from one ankle to another. It is also difficult to carry around or travel with ankle weights of this size.

Accordingly, there is a need for an exercise device that provides sufficient resistance to properly train leg and lower body muscles while being easy to obtain and transport. The present invention fulfills these needs and provides other related advantages.

SUMMARY OF THE INVENTION

The present invention is directed to an exercise device that is convenient to carry, transport, and use so as to more easily train and target leg and lower body muscles. Resistance bands come in various sizes and resistances that can simulate the resistance of a 40-pound ankle weight without the same mass, improving convenience, portability, light weight structure, durability, safety, and economical potential to effectively perform exercises using the legs and lower body.

The exercise device of the present invention attaches to the knee or thigh of one leg, as in a thigh/knee strap, and has a ring to which one or more short resistance bands would attach. The appropriate size and number of resistance bands is chosen in order to make it to an individual's desired weight resistance challenge. The other end of the resistance band(s) would be attached to an ankle strap that attaches to the ankle region of the other leg. The ankle strap would have a strap running behind the heel of the foot so that the most optimum force could be applied in-line with an extended leg.

The exercise device of the present invention has a first assembly with a first strap configured to encircle a user's first bodily appendage, such as a thigh or a foot, with the first strap having a first attachment ring. The exercise device also has a second assembly with a second strap configured to encircle a user's second bodily appendage, such as a foot, with the second strap having a plurality of second attachment rings. The exercise device also has an elastic resistance band configured for connecting at one end to the first attachment ring and at an opposite second end to one of the plurality of second attachment rings.

The first strap may be a thigh strap where the first bodily appendage is a thigh. Alternatively, the first strap may be a foot strap where the first bodily appendage is a foot. The second strap may be a foot strap where the second bodily appendage is a foot. Where the first strap is a thigh strap, the second bodily appendage may be the foot on the same leg or the opposite leg of the user. Where the first strap is a foot strap, the second bodily appendage is the foot on the opposite leg of the user. When the first strap and the second strap are on opposite legs, the relative anatomical positions of the straps are contralateral.

The exercise device may include a plurality of elastic resistance bands, wherein each of the plurality of elastic resistance bands is configured for connecting at one end to the first attachment ring and at an opposite second end separately to one of the plurality of second attachment rings. A user may use any number of elastic resistance bands to adjust the amount of resistance.

In using the exercise device a user would preferably be positioned on hands and knees on the floor or a platform. The leg to which the ankle strap is attached—the "upper leg"—would then be raised at different angles to trigger different muscle groups. Repetitions of this movement would produce the desired results in the muscle group. An angle of activation that would trigger primarily the glutes would be to raise the heel of the upper leg toward the ceiling. Lower angles of activation would target other muscle groups like the quadriceps or hamstrings.

A process for using an exercise device of the present invention, where said exercise device has a first assembly connected to a second assembly by one or more elastic resistance bands, begins with securing the first assembly to a user's first bodily appendage. The second assembly is secured to a user's second bodily appendage. The user is then positioned in a starting position, where the elastic resistance bands are in an unstretched position, i.e., not under tension. The user then moves either the first bodily appendage or the second bodily appendage from the starting position to a finishing position so as to counter resistance to stretching by the elastic resistance bands, i.e., where the elastic resistance bands are under tension in a stretched position. The user then returns either the first bodily appendage or the second bodily appendage to the starting position and repeats the moving and returning steps for a desired number of repetitions.

In a particular exercise, the starting position has the user being on hands and knees on a flat surface with the first bodily appendage being the user's thigh on a first leg and the second bodily appendage being the user's foot on a second leg. The finishing position has the user raising the second bodily appendage away from the flat surface in line with the user's torso and extending the foot of the second bodily appendage toward a ceiling.

In another particular exercise, the starting position has the user being on hands and knees on a flat surface with the first bodily appendage being the user's thigh on a first leg and the second bodily appendage being the user's foot on a second leg. The finishing position has the user raising the second bodily appendage away from the flat surface lateral to the user's torso and keeping the knee of the second bodily appendage bent.

In another particular exercise, the starting position has the user being seated on a chair or bench with the first bodily appendage being the user's thigh on a first leg and the second bodily appendage being the user's foot on a second leg. The finishing position has the user standing in front of the chair or bench with the first bodily appendage raised with both the hip and knee bent at ninety degree angles.

In another particular exercise, the starting position has the user laying prone, face-down on a flat surface with the first bodily appendage being the user's foot on a first leg and the second bodily appendage being the user's foot on a second leg. The finishing position has the user raising the second bodily appendage away from the flat surface in line with the user's torso and extending the foot of the second leg toward a ceiling.

In another particular exercise, the starting position has the user laying prone, face-up on a flat surface with knees raised and bent at ninety degree angles with the first bodily appendage being the user's thigh on a first leg and the second bodily appendage being the user's foot on a second leg. The finishing position has the user keeping the first leg raised and bent at ninety degrees and extending the second leg straight in-line with a torso and the foot lowered toward the flat surface.

In another particular exercise, the starting position has the user standing with feet about hip-width apart with the first bodily appendage being the user's foot on a first leg and the second bodily appendage being the user's foot on a second leg. The finishing position has the user extending the foot on the first leg laterally away from the foot on the second leg.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

The inventive exercise apparatus is designed to aid in the building of the muscles of the legs and lower bodies, particularly the gluteal muscles. The apparatus is designed to place the individual in the proper position to activate and target a specific muscle. The inventive exercise apparatus was designed primarily with the gluteus muscles in mind. The position the individual is in when performing exercises with the inventive apparatus is specifically designed to help in the muscular development and toning of the targeted muscle; providing an angle of activation for the intended muscle group.

Figure 1:
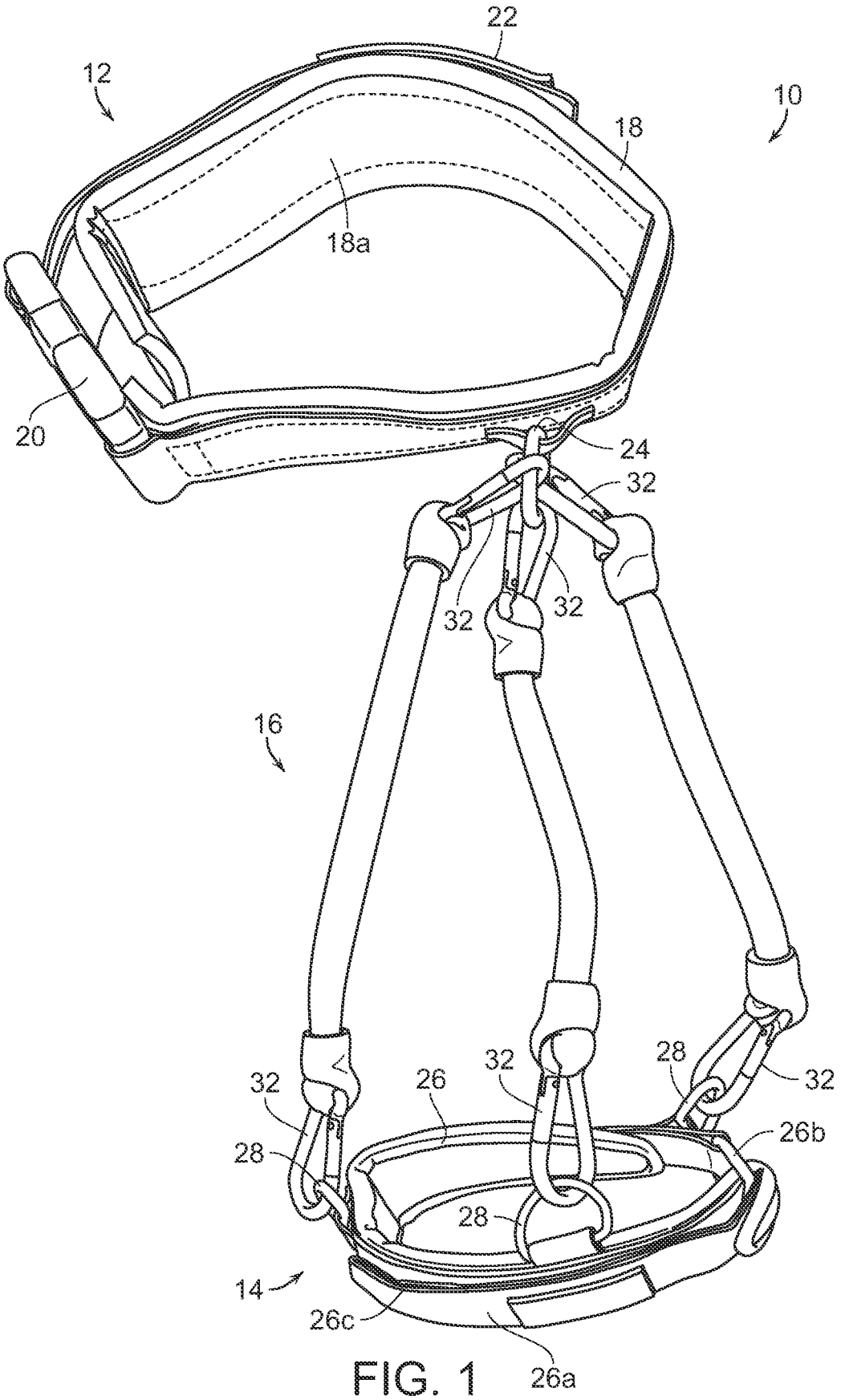
FIG. 1 is a perspective view of the exercise device according to the present invention.

The inventive exercise apparatus is designed to supplement a gluteal focused workout and help to tone, firm up, and grow the gluteus musculature, thereby making for a more convenient and comfortable fit for the user. The exercise apparatus, generally referred to by reference numeral 10, is illustrated in FIG. 1. The exercise device 10 generally comprises a thigh assembly 12, a foot assembly 14, and one or more resistance bands 16. The resistance bands 16 are connected at opposite ends to the thigh assembly 12 and the foot assembly 14.

Figure 2:
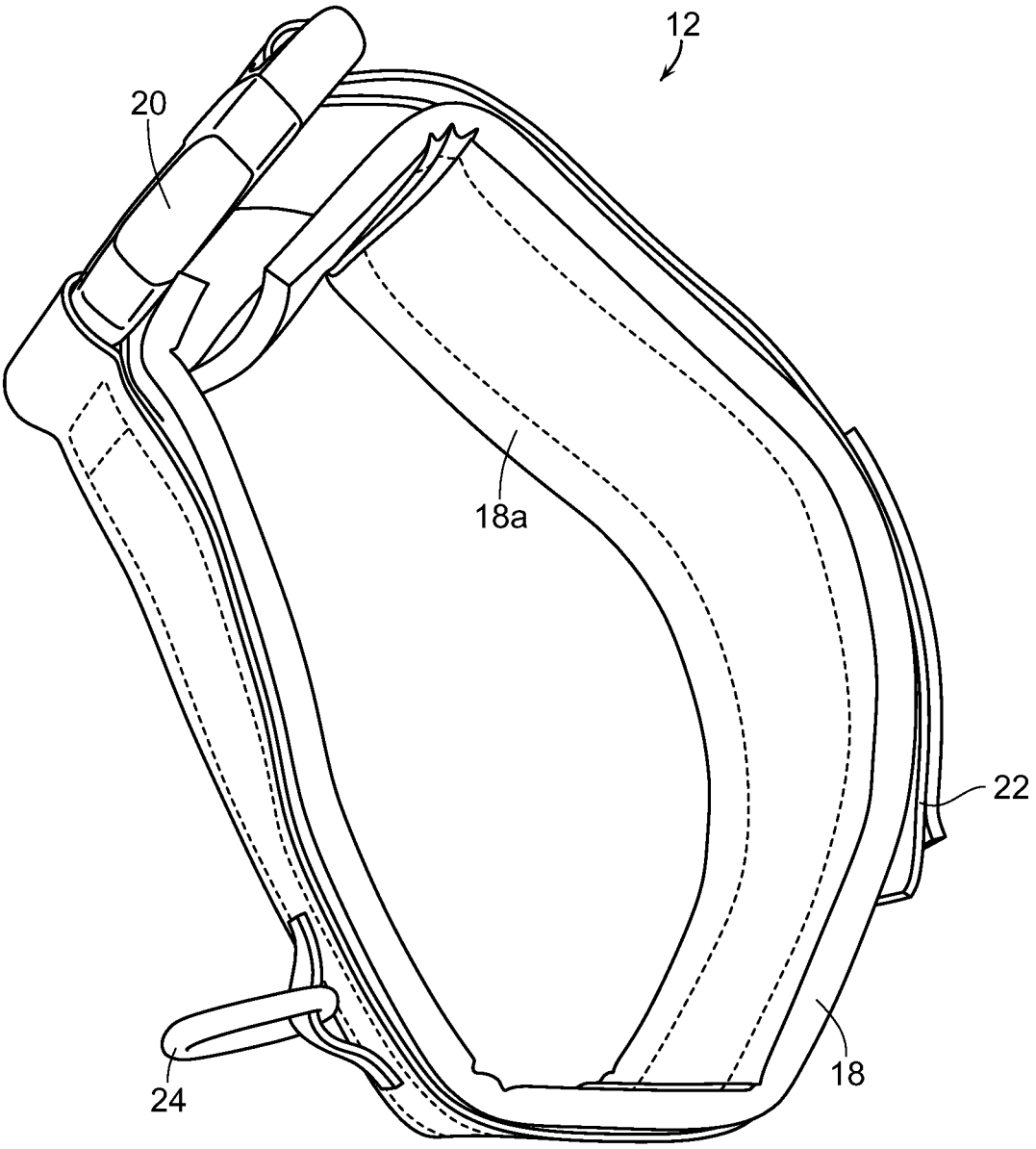
FIG. 2 is a close-up view of a closed thigh assembly of the exercise device according to the present invention.
Figure 3:
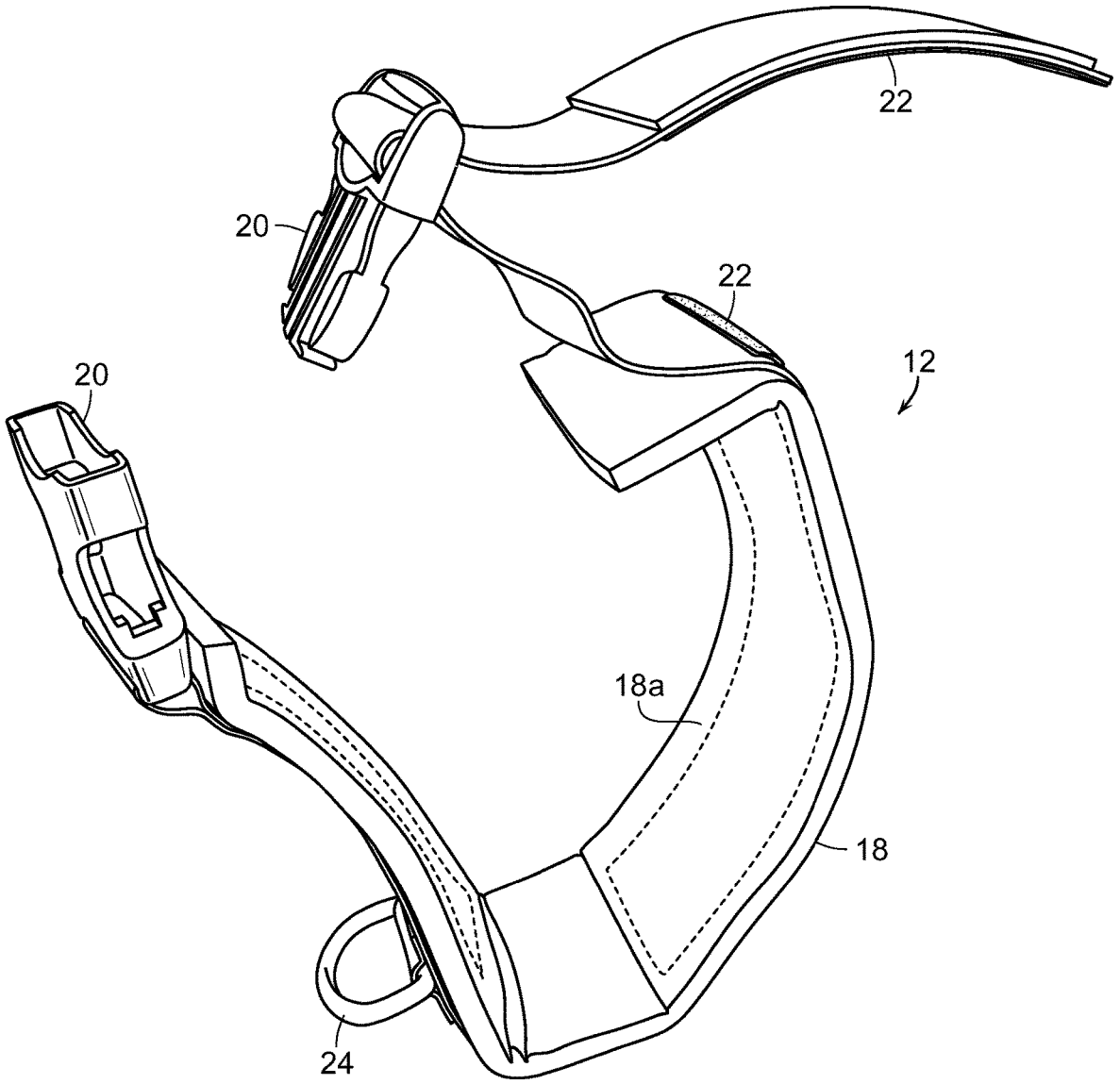
FIG. 3 is a close-up view of the open thigh assembly of the exercise device according to the present invention.
Figure 3A:
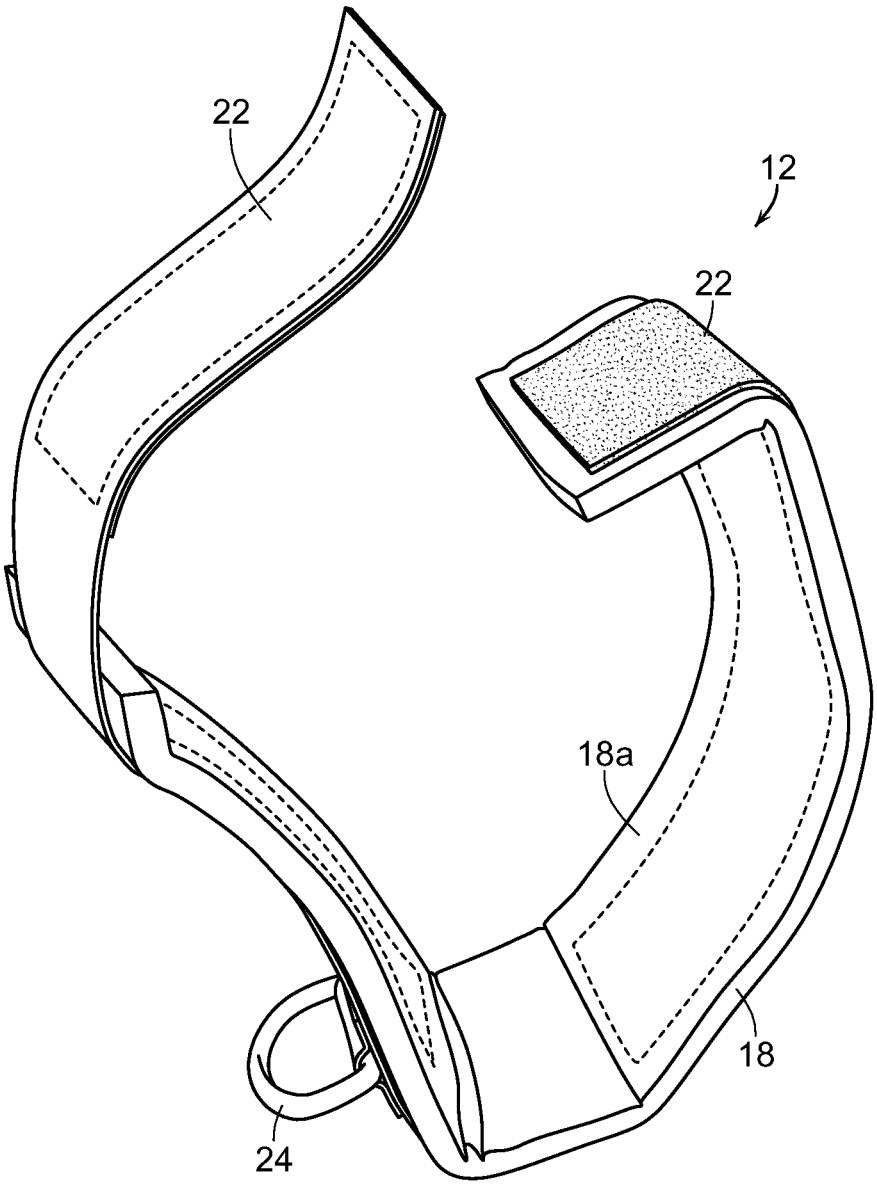
FIG. 3A is a close-up view of an alternate embodiment of the thigh assembly of the exercise device according to the present invention.

FIGS. 2-3A generally illustrate multiple embodiments of the thigh assembly 12. The thigh assembly 12 generally consists of a soft but durable thigh strap 18 sized to securely encircle a user's thigh, and includes a cushioning pad 18*a* to offer protection from rubbing or chaffing. The thigh strap 18 may be a permanently closed loop or an adjustable loop that may be opened as by a buckle 20 or hook and loop attachment 22. The permanently closed loop variation, i.e., sleeve, of the thigh assembly 18 is designed to fit over a user's foot to be pulled up to the thigh/knee area. The sleeve has the advantage of providing a greater level of comfort to the user with less likelihood that the buckle may interfere or create discomfort for the user.

The buckle 20 or hook and loop attachment 22 preferably allows for adjustment in the size of the loop to accommodate users with different size thighs. Compared to the sleeve, the buckle 20 and hook and loop attachment 22 has the advantage of being easier to put-on and take-off. The thigh strap 18 also includes at least one attachment ring 24 sized and configured to receive the resistance bands 16 as described more fully below.

The thigh strap 18 is preferably made from an inelastic material so as to minimize stretching during exercise, which would counter the action of the resistance bands 16. Alternatively, the thigh strap 18 may be slightly elastic so as to allow for greater ease and comfort when securing the thigh strap 18 to a user's leg, particularly beneficial when securing the closed loop variation of the thigh strap 18 to a user's thigh/knee area. The thigh strap 18 is preferably secured at or immediately above a user's knee, with the attachment ring 24 positioned behind the user's knee.

Figure 4:
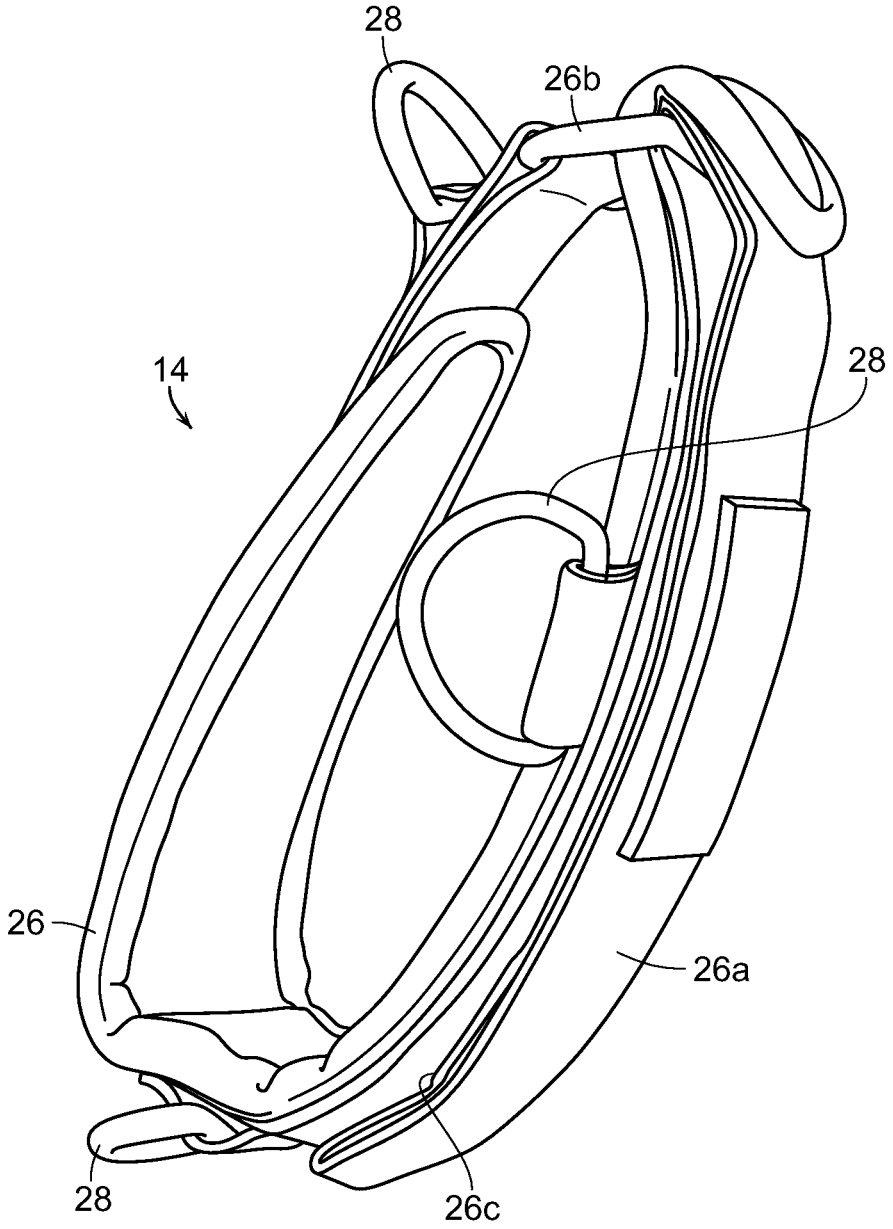
FIG. 4 is a close-up view of a closed foot strap of the exercise device according to the present invention.
Figure 5:
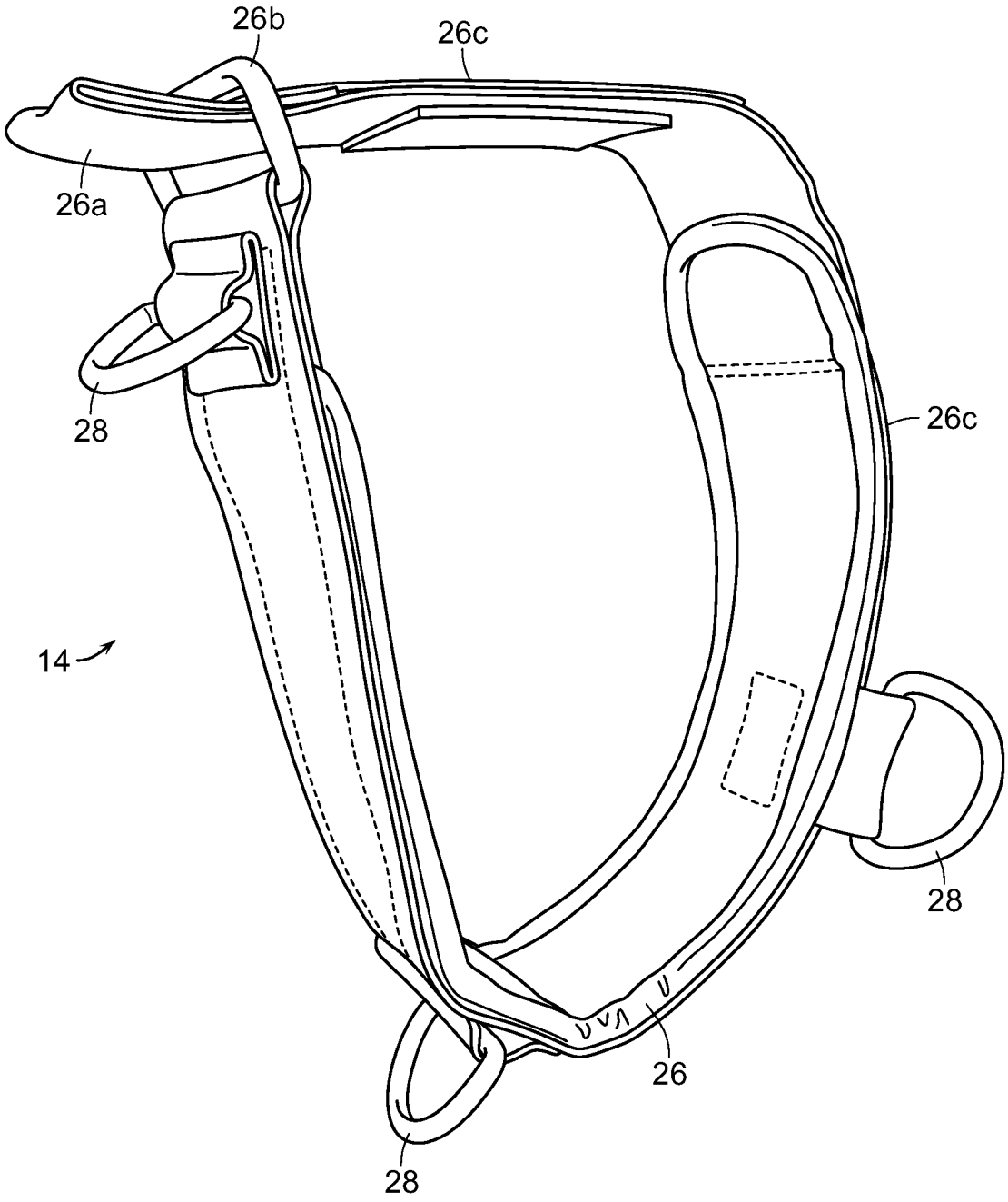
FIG. 5 is a close-up view of the opened foot strap of the exercise device according to the present invention.
Figure 6:
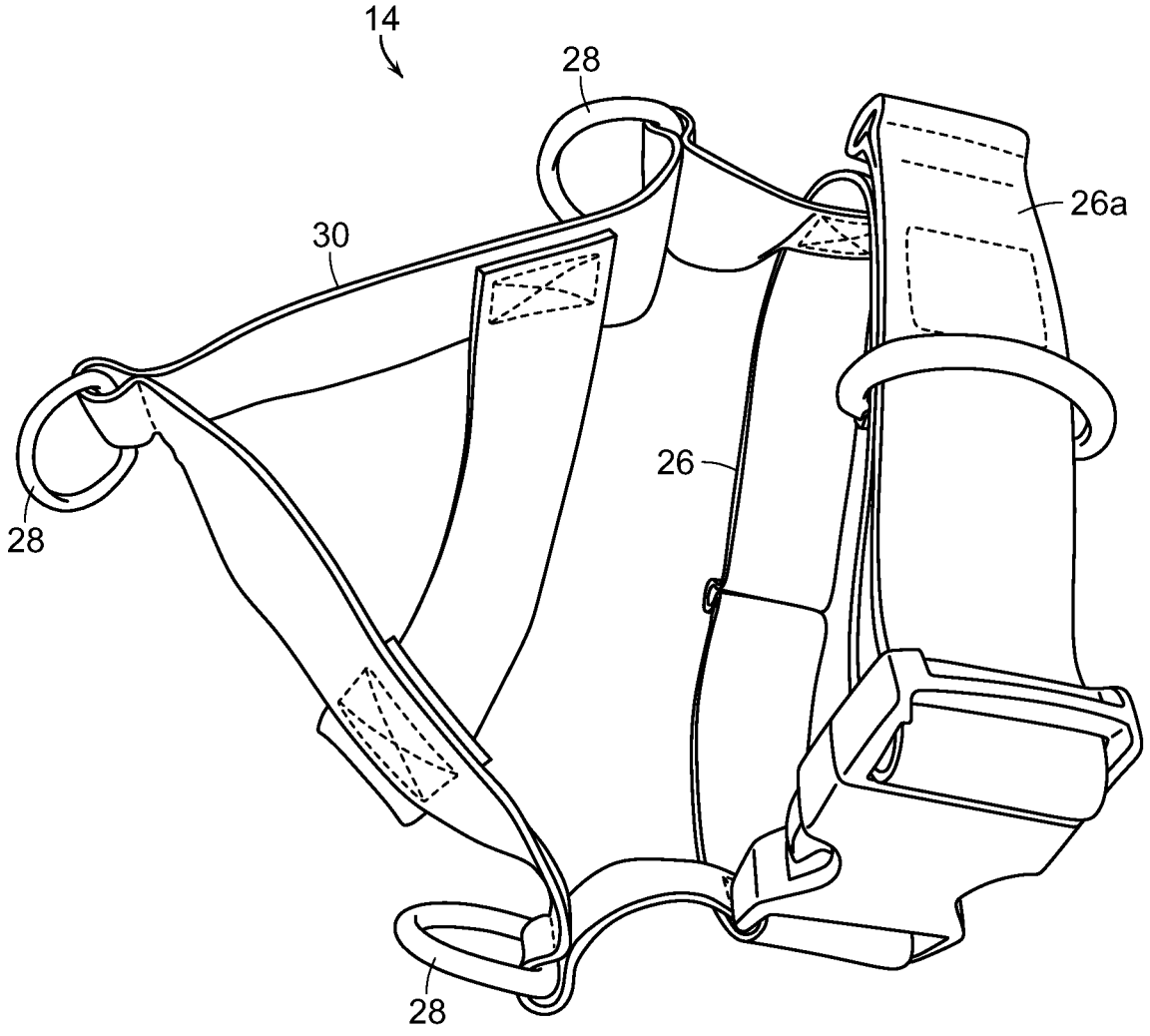
FIG. 6 is a close-up view of an alternate embodiment of the foot strap of the exercise device according to the present invention.

As shown in FIGS. 4-6, the foot assembly 14 comprises a single foot strap 26 made of durable nylon or similar material configured to encircle a user's foot proximate to the arch. The foot strap 26 may be adjustably sized to be used with or without shoes or similar footwear. The foot strap 26 may be configured in such a way that there will be a plastic side release buckle or hook and loop closure that not only keeps the foot strap 26 locked in for safety purposes but is adjustable for any foot size. The foot strap 26 may also comprise a sleeve configuration as discussed above for the thigh strap 18. In its adjustable configuration, the foot strap 26 preferably has an extra length of strap 26*a* that is drawn through a plastic loop 26*b* and folded back on itself to be secured as by hook and loop material 26*c*.

The foot strap 26 also includes at least one attachment ring 28, but preferably three attachment rings 28. At least one of the attachment rings 28 is configured so as to be positioned on top of the user's foot, i.e., proximate to the laces on a shoe. Additional attachment rings 28 may be positioned proximate to the lateral arch and/or the medial arch of the user's foot. Attachment of resistance bands 16 to rings 28 in different positions relative to the foot will result in activation of different muscle groups as described below.

As with the thigh strap 18, the foot strap 26 is preferably made from an inelastic material so as to minimize stretching during exercise, which would counter the resistance bands 16. Alternatively, the foot strap 26 may be slightly elastic so as to allow for greater ease and comfort when securing the foot strap 26 to a user's foot, particularly not wearing shoes. The foot strap 26 is preferably secured at or proximate to the arch of a user's foot, with at least one attachment ring 28 positioned on top of the user's foot.

Shown in FIG. 6, an alternate embodiment of the foot strap 26 may include a heel strap 30 configured to extend from the arch of the user's foot to encircle and secure the user's heel. The heel strap 30 may include additional attachment rings 28.

The ankle strap may be designed to force a particular angle of activation in a user, thus more easily and effectively targeting a particular muscle group as its highest priority. To do this, the ankle strap may include two straps that run across the bottom of the foot. The first strap runs under the arch of the foot and over the top of the foot to secure the ankle strap.

The second strap runs under the heel of the foot. The heel strap is important because this is the strap that the foot can push with the most force. This position on the heel aligns the force of the resistance band along the line of the leg bones directly into the hip joint to directly target the gluteal muscles. The pressure exerted on the heel by the second strap runs directly along the leg bones for the activation of the gluteal muscle.

The short resistance bands 16 comprise the third piece of the inventive exercise apparatus 10. The apparatus 10 preferably includes multiple short resistance bands 16 of different resistance weights so as to provide multiple resistances with different combinations of the various bands 16. Preferably, the apparatus is provided with at least three resistance bands 16 of about ten pounds, twenty pounds, and thirty pounds.

The ends of each of the short resistance bands 16 preferably have a plastic or metal clip, carabiner, or other commonly used device 32 to safely and securely attach the resistance bands 16 to the attachment rings 24, 28 on the thigh strap 18 and foot strap 26, respectively. The attachment ring 24 on the thigh strap 18 is configured to attach one end of the desired number of short resistance bands 16 to the thigh strap 18. The attachment rings 28 on the foot strap 26 are likewise configured to attach an opposite end of the desired number of short resistance bands 16 to the foot strap 26.

Figure 7:
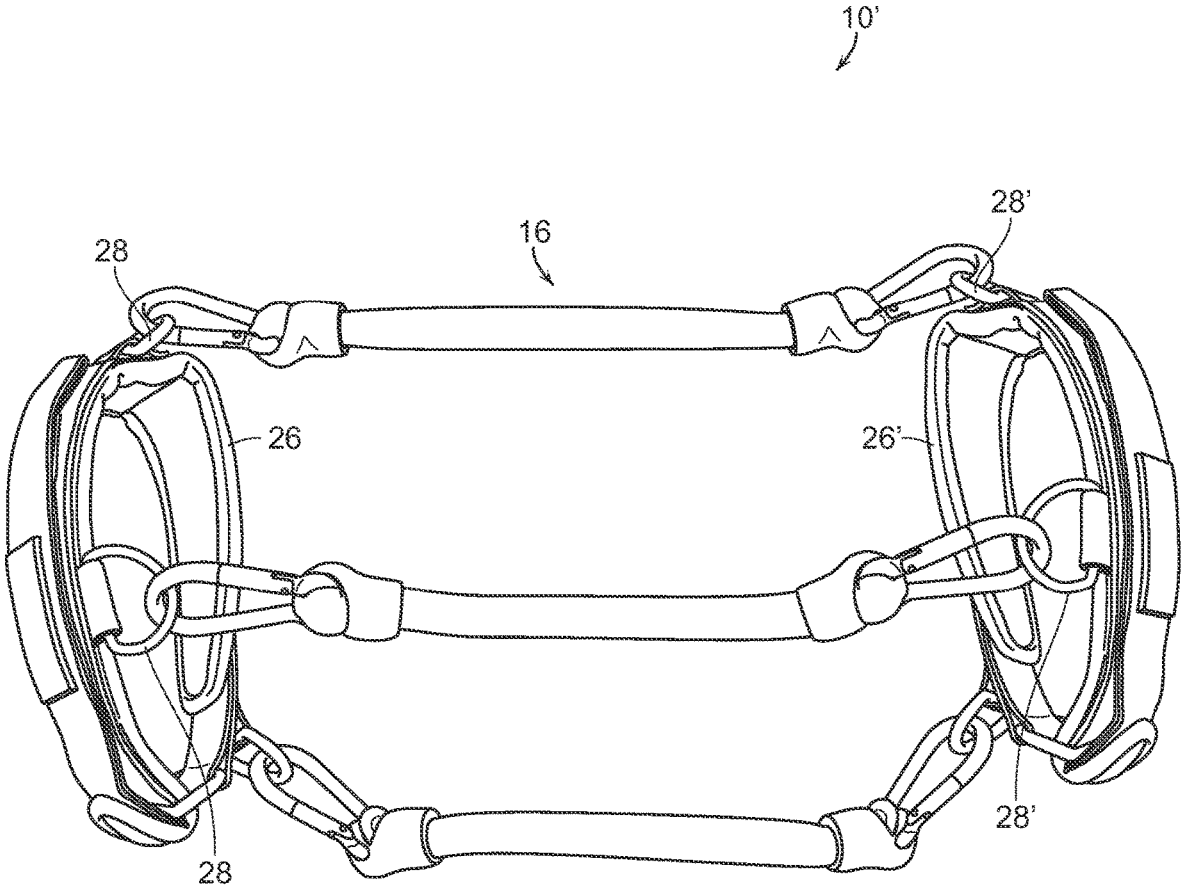
FIG. 7 is a perspective view of an alternate embodiment of the exercise device according to the present invention.

FIG. 7 shows an alternate embodiment of the inventive exercise device 10'. In this alternate embodiment, the exercise device 10' replaces the thigh strap 18 with a second foot strap 26'. With a second foot strap 26', the resistance bands 16 can connect the attachment rings 28 of the first foot strap 26 to the attachment rings 28' of the second foot strap 26'. As user can then perform exercises with the exercise device 10' connected to both feet 42 as opposed to one foot 42 and one thigh/knee 38.

Figure 8:
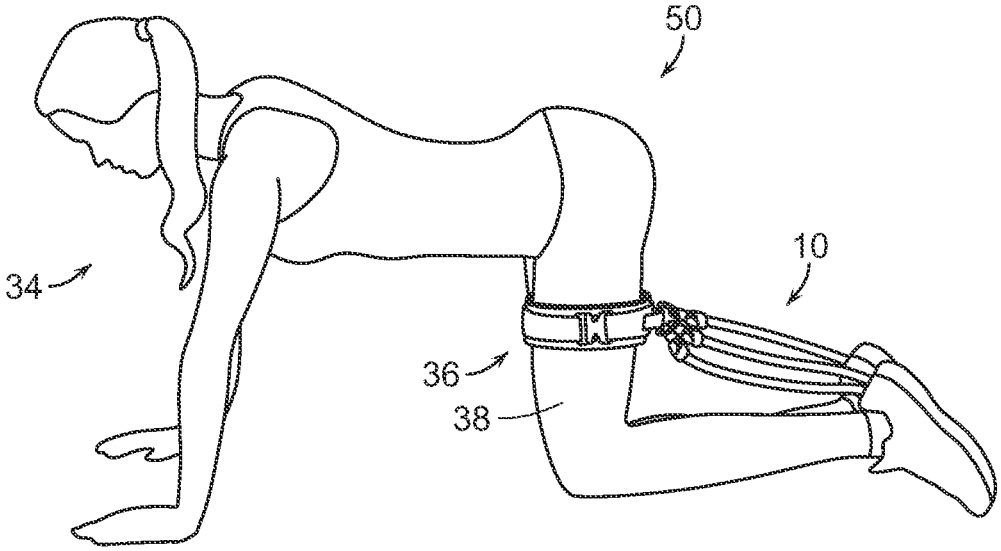
FIG. 8 is an environmental view illustrating a starting position for a first exercise using the exercise device of the present invention.
Figure 9:
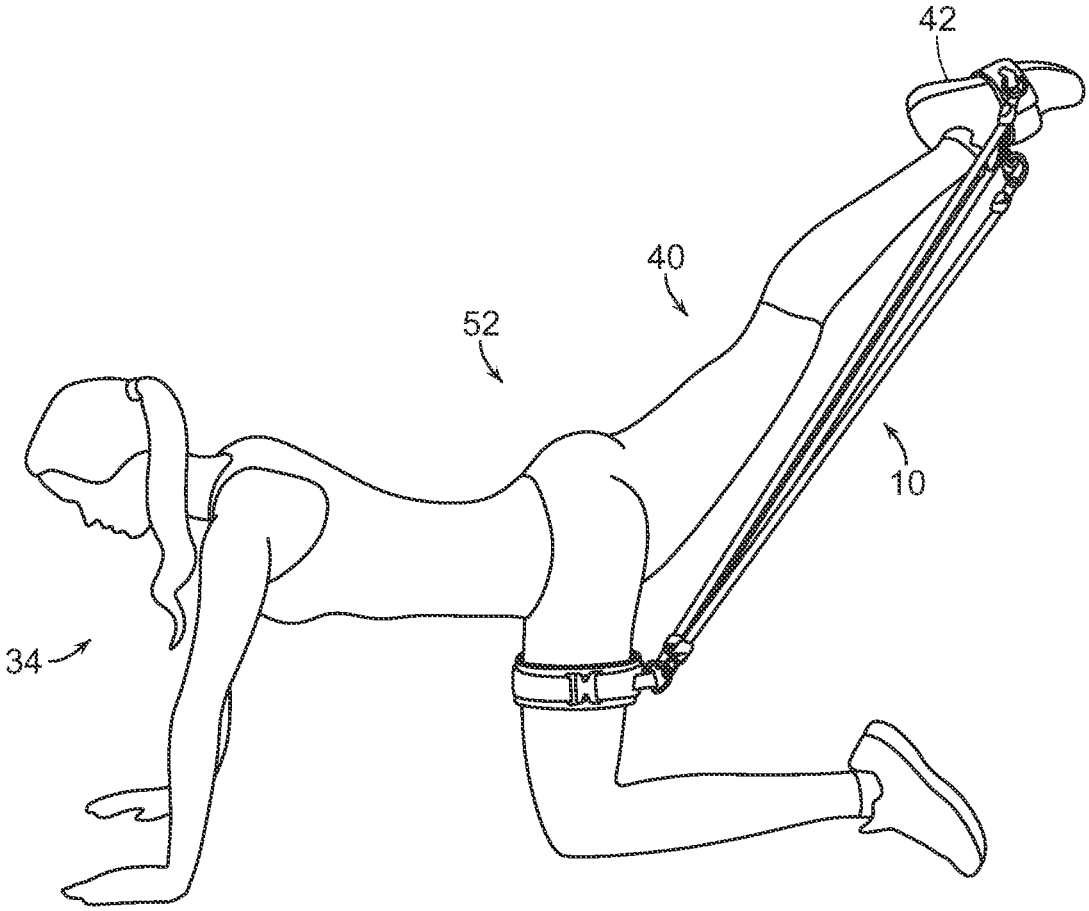
FIG. 9 is an environmental view illustrating a finishing position for a first exercise using the exercise device of the present invention.

As shown in FIGS. 8 and 9, the exercise device 10 is preferably utilized by a person/user 34 in a hands/knees pose. FIG. 8 generally illustrates a starting position 50 for a first exercise using the inventive device 10. As shown, the user 34 attaches the thigh strap 18 to a first leg 36 at or immediately above the knee 38. The user 34 then attaches the foot strap 26 to a second leg 40, at or proximate to the arch of the foot 42. The user can switch legs to which the thigh strap 18 and foot strap 26 are attached to properly exercise both sides.

The resistance bands 16 are selected in preferred resistance strength and sized so as to be at nominal extension, i.e., without slack, when the user 34 is in the starting position 50. Alternatively, the starting position 50 may involve more than nominal resistance in the bands 16. One should try to avoid the absence of resistance in the bands 16 in the starting position 50. The requirement of nominal or more than nominal resistance in the bands 16 in the starting position 50 is intended to maintain tension on the user's muscles to promote more efficient exercise and minimize the chance of injury.

Performance of the exercise involves the user 34 extending the second leg 42 to which the foot strap 26 is attached until the second leg 42 is generally straight, extending at an angle of activation of between zero degrees and ninety degrees relative to a horizontal plane. This is known as the finish position 52 shown in FIG. 9. Repetitions of the exercise are performed by repeatedly moving from the starting position 50 to the finish position 52 and then back to the starting position 50. As with most other exercises, a user should control the repetition of movement to avoid injury, and be careful to avoid over or hyper extension of a joint like the knee.

The angle of activation discussed above refers to the angle at which the second leg 42 is raised with respect to the floor or other horizontal surface. Extending the second leg 42 back such that it extends substantially parallel to the horizontal would primarily target the quadriceps and hamstring muscles. In contrast, raising the second leg 42 toward the ceiling such that it extends substantially perpendicular to the horizontal would focus the resistance more on the gluteal muscles. Variations between horizontal and vertical extensions will have moderating effect of the specific muscle focus.

This inventive exercise device 10 provides superior training and responsiveness to the target muscle groups of the glutes and legs.

Safety: The thigh strap 18 securely locks around the user's thigh and will not slip. The resistance bands 16 are attached to the ring 24 with carabiners 32 or similar latches that ensure they are securely fastened and unable to unlock without the assistance of the user. The foot strap 26 also uses a buckle system to securely lock in the foot to prevent slipping.

Convenience: The inventive exercise device 10 places the user in the perfect position to target a specific muscle group. No thinking necessary. Just strap in and go. All the parts needed are provided to the user, assembled and ready to go.

Portability: The inventive exercise device 10 is light weight and maneuverable. It can fit in any small bag and does not add excessive weight while traveling; unlike a twenty or forty-pound weighted ankle strap or dumbbells.

Effectiveness: The inventive exercise apparatus is provided with the proper tools to challenge the individual and truly produce visible results, from toning and firming to creating muscle growth.

Angle of Activation: Due to the points of attachment on the individual, the inventive exercise apparatus produces the optimum angle at which the gluteal muscles can fire without bringing in secondary muscle groups. This allows for isolation of the intended muscle group.

Hassle Free: The inventive exercise apparatus is easy to use and takes seconds to strap on and begin using, in part, because of the simple buckle system.

Experimental uses of the inventive exercise apparatus have resulted in subjects feeling activation in their gluteal muscles. Individual users were observed over a period of time with regular exercise. User's noted that within a couple days after using the inventive exercise apparatus, individuals felt muscle soreness in the desired muscle, indicating proper usage and targeting of the muscle groups. Specific exercises have been observed to have particular effectiveness on certain muscles or muscle groups.

Donkey Kickbacks:

If a user wants to target the gluteus maximus, the user can perform an exercise using the exercise device 10 called "Donkey Kickbacks", starting in the hands and knees position 50 shown in FIG. 8. The thigh strap 18 is positioned just above the knee 38 on the first leg 36 and the foot strap 26 is positioned on the foot 42 of the second leg 40. The resistance bands 16 can be attached in the desired weight to all rings 28 on the foot strap 26. The user begins lifting the second leg 40 in a controlled manner, keeping the knee bent. The gluteal muscle is used to press the foot 42 of the second leg 40 directly toward the ceiling at a 45-degree angle relative to the horizontal, with a squeeze of the gluteal muscle at the top of the extension in the finish position 52 shown in FIG. 9. The user should be careful to maintain the pelvis and working hip pointing toward the ground. The user then returns to the starting position 50 in a controlled manner and repeats for the desired number of repetitions. The exercise is then repeated on the other side by switching the legs to which the thigh strap 18 and foot strap 26 are attached.

Fire Hydrants:

If a user wants to target the gluteus medius muscle, the user can perform an exercise using the exercise device 10 called "Fire Hydrants", starting on the hands and knees position 50 shown in FIG. 8. The thigh strap 18 is positioned just above the knee 38 on the first leg 36 and the foot strap 26 is positioned on the foot 42 of the second leg 40. The resistance bands 16 can be attached in the desired weight to all rings 28 on the foot strap 26. The user begins lifting the second leg 40 in a controlled manner to the side until the thigh is parallel to the floor, keeping the knee bent at a 90-degree angle. This exercise does not involve the finish position 52 shown in FIG. 9. Again, the user should be careful to maintain the pelvis parallel to the ground. The user then returns to the starting position 50 in a controlled manner and repeats for the desired number of repetitions. The exercise is then repeated on the other side by switching the legs to which the thigh strap 18 and foot strap 26 are attached.

Figure 10:
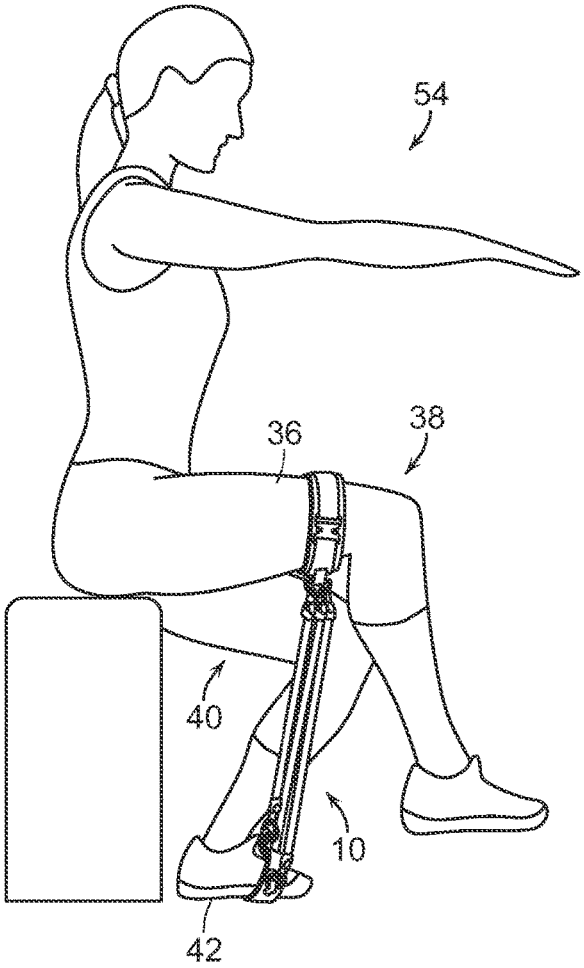
FIG. 10 is an environmental view illustrating a starting position for a second exercise using the exercise device of the present invention.
Figure 11:
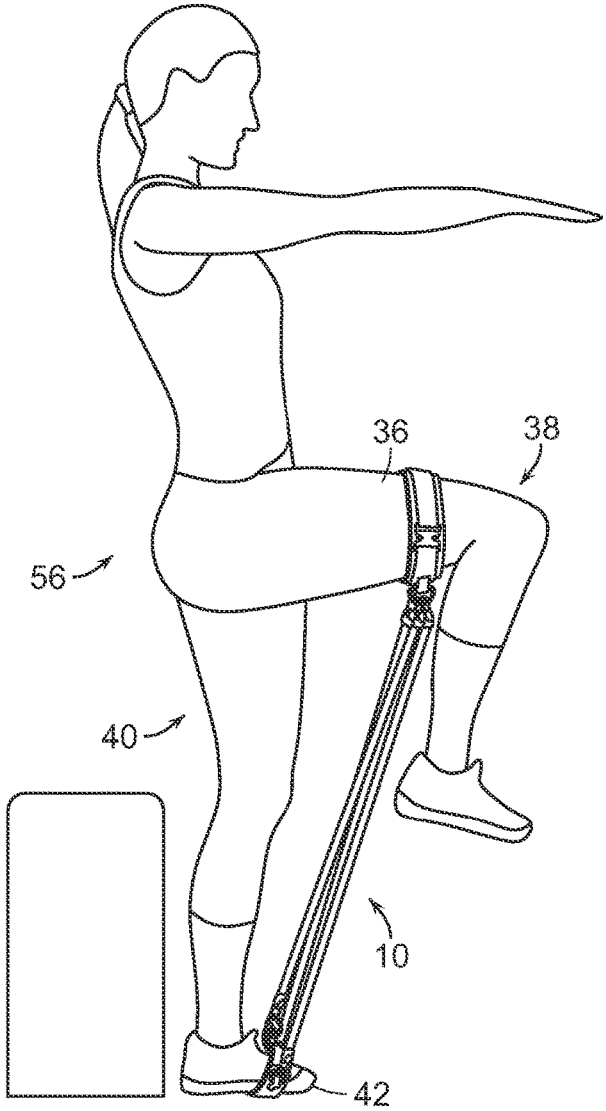
FIG. 11 is an environmental view illustrating a finishing position for a second exercise using the exercise device of the present invention.

Single Leg Get Ups:

If a user wants to target the piriformis muscle, the user can perform an exercise using the exercise device 10 called "Single Leg Get Ups", starting in a seated position on a bench or chair, back upright and core braced in the starting position 54 of FIG. 10. The thigh strap 18 is positioned just above the knee 38 on the first leg 36 and the foot strap 26 is positioned on the foot 42 of the second leg 40. The resistance bands 16 can be attached in the desired weight to all rings 28 on the foot strap 26. The user begins by raising the body in a controlled manner to a standing position by pushing through the heel of the foot and extending the hips and knee—all of the second leg 40. The knee 38 of the first leg 36 is kept elevated and locked at a 90-degree angle in the finish position 56 shown in FIG. 11. The user should make sure to squeeze the gluteal muscles at the top and then lower back to the seated position in a controlled manner and repeat for the desired number of repetitions. The exercise is then repeated on the other side by switching the legs to which the thigh strap 18 and foot strap 26 are attached.

Figure 12:
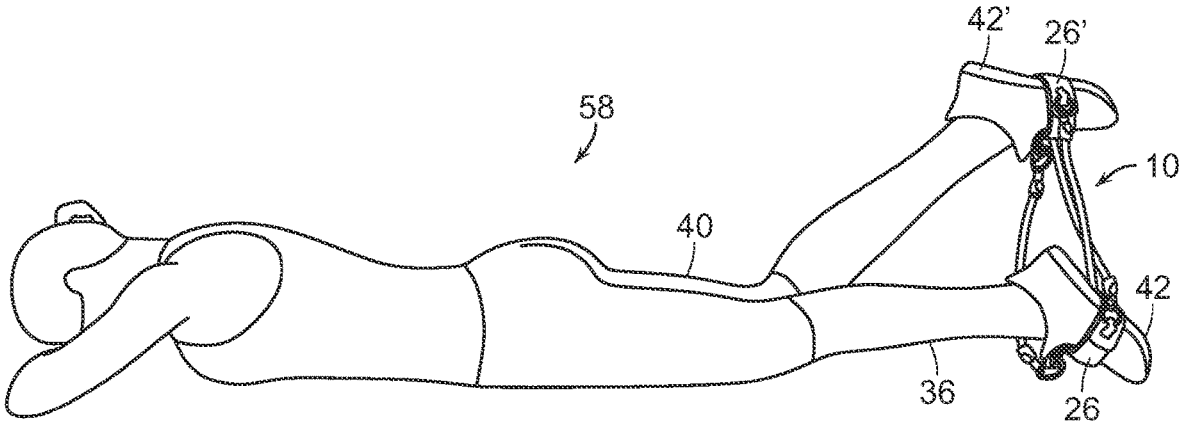
FIG. 12 is an environmental view illustrating a starting position for a third exercise using the exercise device of the present invention.
Figure 13:
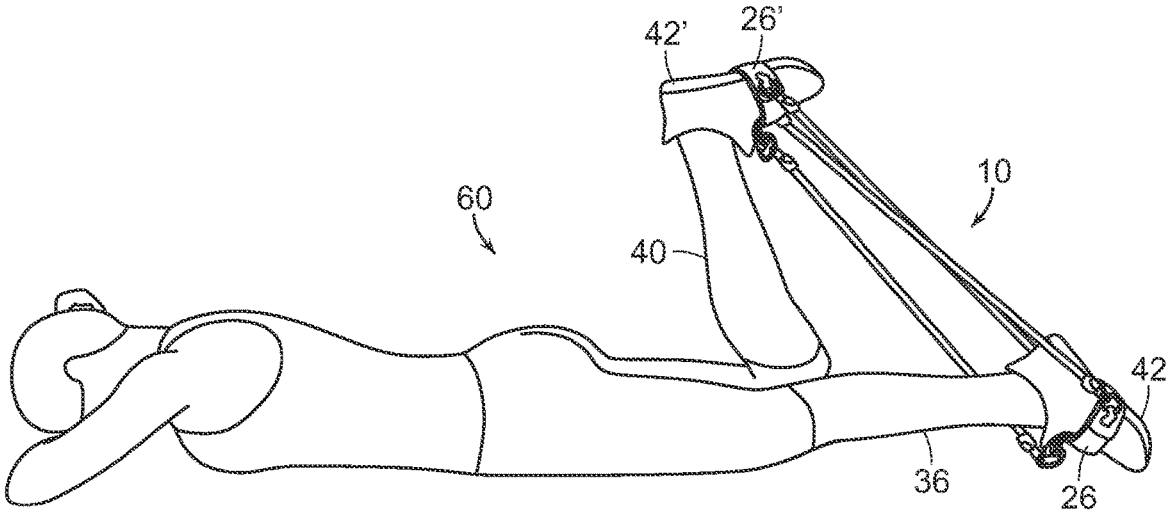
FIG. 13 is an environmental view illustrating a finishing position for a third exercise using the exercise device of the present invention.

Leg Curls:

If a user wants to target the long head biceps femoris muscle, the user can perform an exercise using the exercise device 10 called "Leg Curls", starting in a prone position, face down on the floor or a bench, legs straight in the starting position 58 of FIG. 12. The foot strap 26 is positioned on the foot 42 of the first leg 36 and the second foot strap 26' is positioned on the foot 42' of the second leg 40. The resistance bands 16 can be attached in the desired weight to all rings 28 on the foot straps 26, 26'. Keeping the first leg 36 straight and on the floor or bench, the user slowly bends the second leg 40 at the knee 38 bringing the foot 42 closer to the gluteal muscle as shown in the finish position 60 in FIG. 13. The bottom of the foot 42 should be maintained facing the ceiling throughout the movement. The second leg is then slowly returned to the starting position in a controlled manner and repeated for the desired number of repetitions without losing resistance in the bands 16. The exercise is then repeated on the other side by switching which leg the user bends—there is no need to switch to which leg the bands are attached.

Figure 14:
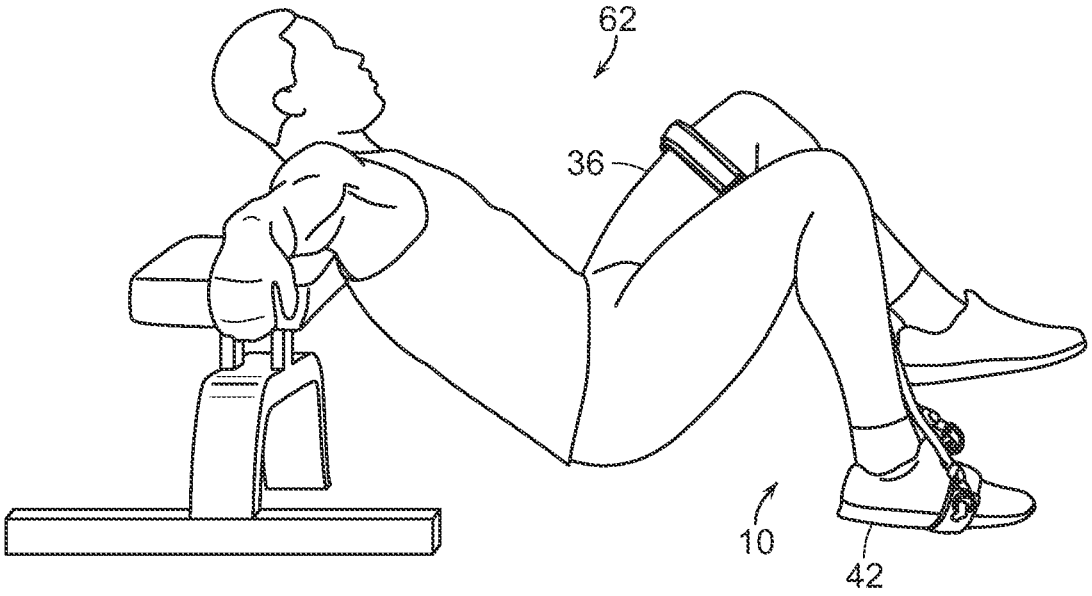
FIG. 14 is an environmental view illustrating a starting position for a fourth exercise using the exercise device of the present invention.
Figure 15:
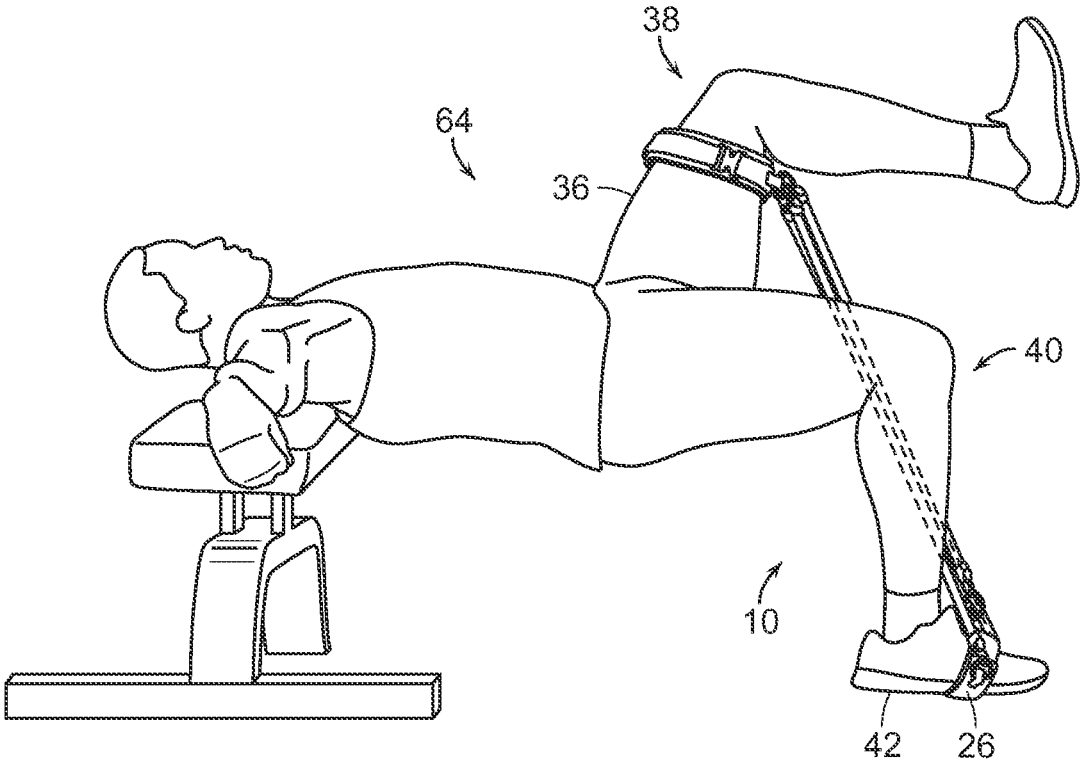
FIG. 15 is an environmental view illustrating a finishing position for a fourth exercise using the exercise device of the present invention.

Single Leg Hip Thrusts:

If a user wants to target the gluteus maximus and gluteus medius muscles together, the user can perform an exercise using the exercise device 10 called "Single Leg Hip Thrusts", starting with their back against a bench, preferably perpendicular to a long dimension of the bench, hips and feet on the floor, knees bent and directly over feet as shown in the starting position 62 of FIG. 14. The thigh strap 18 is positioned high on the thigh of the first leg 36, proximate to the groin area (inguinal canal) and the foot strap 26 is positioned on the foot 42 of the second leg 40. The resistance bands 16 can be attached in the desired weight to all rings 28 on the foot strap 26. Raising the first leg 36 bending the hip and knee to both form 90-degree angles, the user places their elbows against the bench and pushes the knees out, squeezing the gluteal muscles and raising the hips until the torso, hips and knee of the second leg 40 are in alignment as shown in finish position 64 of FIG. 15. The hips and knees are then slowly returned to the starting position in a controlled manner and repeats for the desired number of repetitions. The exercise is then repeated on the other side by switching the thigh strap 18 to the second leg 40, the foot strap 26 to the first leg 36, and bending the second leg 40 as described above.

Figure 16:
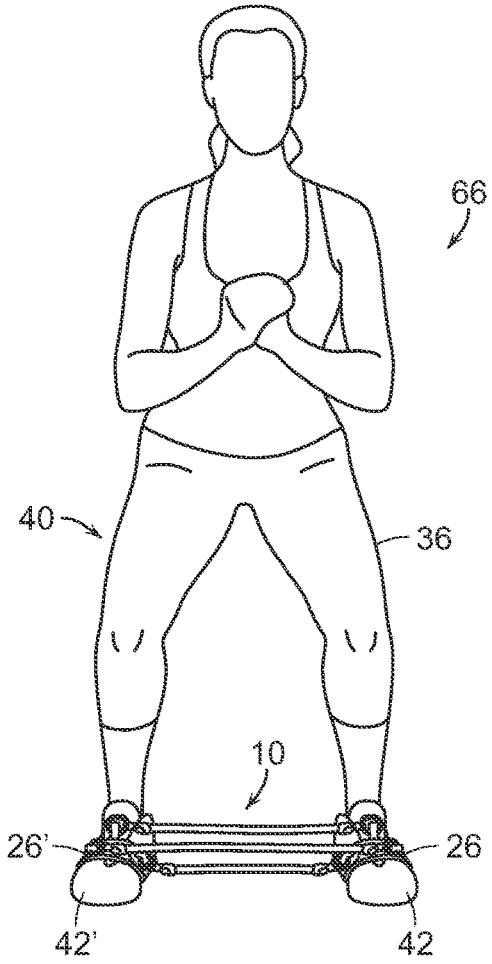
FIG. 16 is an environmental view illustrating a starting position for a fifth exercise using the exercise device of the present invention.
Figure 17:
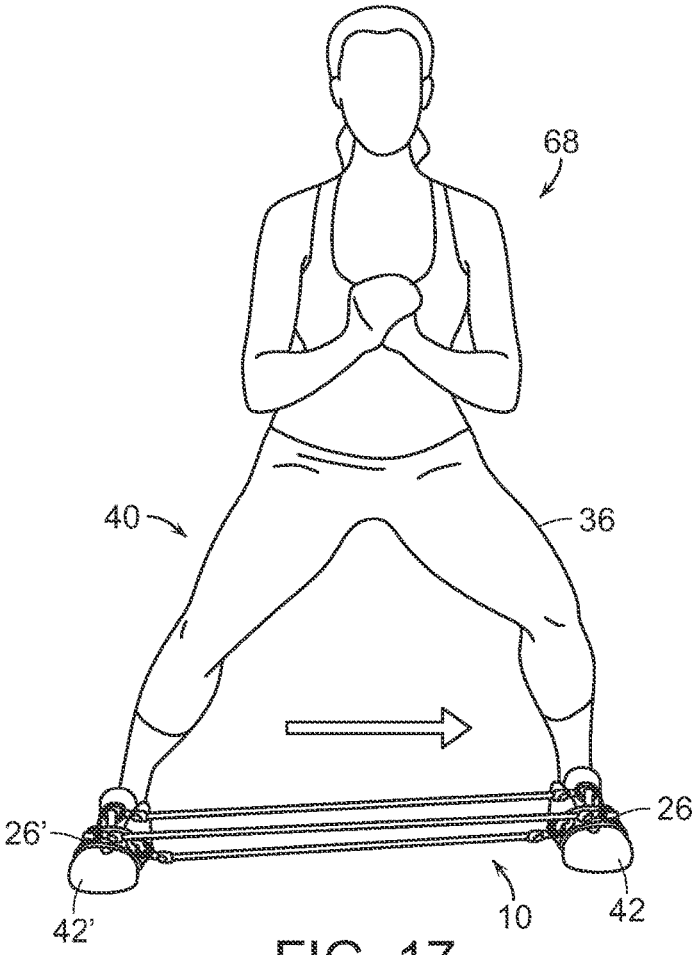
FIG. 17 is an environmental view illustrating a finishing position for a fifth exercise using the exercise device of the present invention.

Lateral Tube Walks:

If a user wants to target the gluteus medius muscle, the user can perform an exercise using the alternate exercise device 10' called "Lateral Tube Walks", starting in a standing position, toes pointed forward, knees over feet and hands on hips in the starting position 66 of FIG. 16. The foot strap 26 is positioned on the foot 42 of the first leg 36 and the second foot strap 26' is positioned on the foot 42' of the second leg 40. The resistance bands 16 can be attached in the desired weight to all rings 28 on the foot straps 26, 26'. Keeping the legs 36, 40 generally straight (but not locking-out the knees), the user takes one large step laterally with the first leg 36, stretching the bands 16 to the maximum comfortable resistance as shown in finish position 68 of FIG. 17. The second leg 40 brought laterally closer to the first leg 36 to return to the start position 66 of FIG. 16 and repeated for the desired number of repetitions without losing resistance in the bands 16. The exercise is then repeated on the other side by switching which leg 36, 40 the user steps laterally with first—there is no need to switch to which leg the straps 26, 26' are attached.

Figure 18:
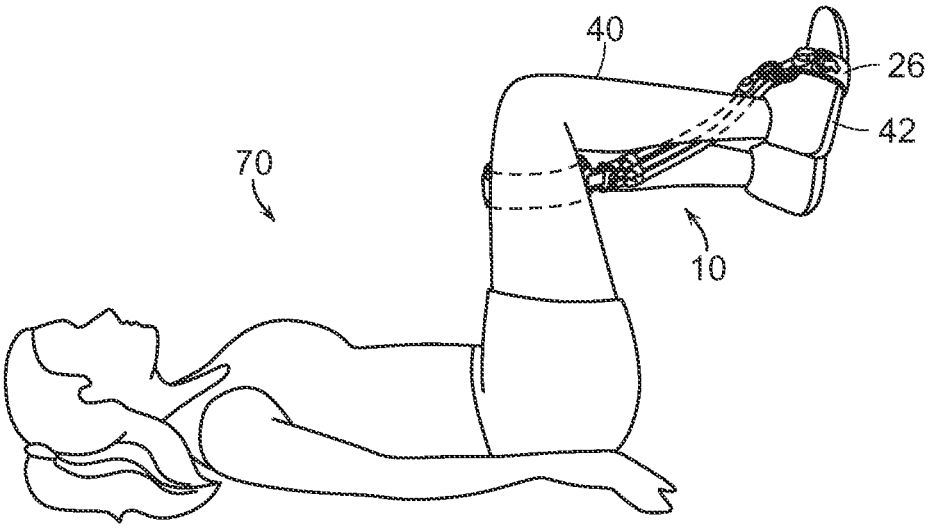
FIG. 18 is an environmental view illustrating a starting position for a sixth exercise using the exercise device of the present invention.
Figure 19:
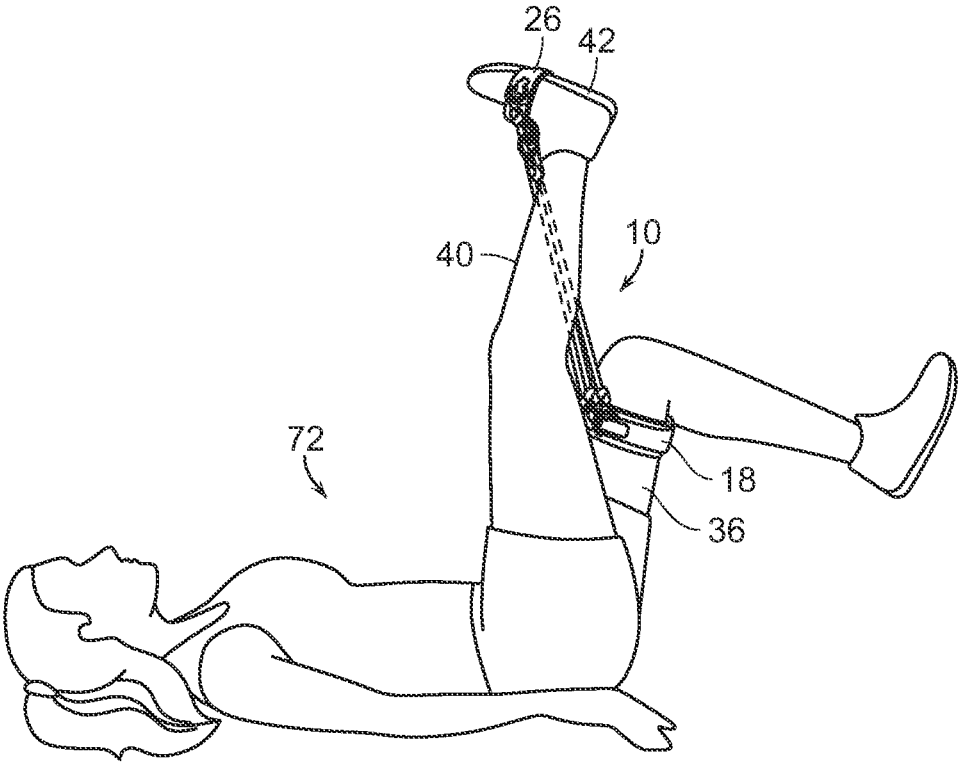
FIG. 19 is an environmental view illustrating a finishing position for a sixth exercise using the exercise device of the present invention.

Single Leg Press:

If a user wants to target the gluteus maximus and piriformis muscles, the user can perform an exercise using the exercise device 10 called "Single Leg Press", starting in a position laying face up on the floor or a bench, knees raised with hips and knees at 90-degree angles in the starting position 70 of FIG. 18. The thigh strap 18 is positioned just above the knee 38 of the first leg 36 and foot strap 26 is positioned on the foot 42 of the second leg 40. The resistance bands 16 can be attached in the desired weight to all rings 28 on the foot strap 26. Keeping the legs 36, 40 raised with the knees at generally 90-degree angles, the user fully extends the second leg 40 and slightly lowers the heel toward the ground in finish position 72 of FIG. 19. The second leg 40 is then brought back to the 90-degree bent position to return to the start position 70 of FIG. 18 and repeated for the desired number of repetitions without losing resistance in the bands 16. The exercise is then repeated on the other side by switching the legs to which the thigh strap 18 and foot strap 26 are attached.

Although several embodiments have been described in detail for purposes of illustration, various modifications may be made without departing from the scope and spirit of the invention. Accordingly, the invention is not to be limited, except as by the appended claims.

What is claimed is:

1. A process for using an exercise device, said exercise device comprising a first assembly connected to a second assembly by one or more elastic resistance bands, the process comprising the steps of:

securing the first assembly to a user's thigh on a first leg as a first bodily appendage, wherein the one or more elastic resistance bands are connected to an attachment ring on the first assembly;

securing the second assembly to a user's arch of a foot on a second leg as a second bodily appendage that is contralateral to the first bodily appendage, wherein the one or more elastic resistance bands are connected to separate attachment rings on the second assembly, contralaterally with respect to the attachment ring on the first assembly;

positioning the user in a starting position wherein the one or more elastic resistance bands are an unstretched position;

moving either the user's first bodily appendage or second bodily appendage from the starting position to a finishing position wherein the one or more elastic resistance bands are in a stretched position;

returning either the user's first bodily appendage or second bodily appendage to the starting position; and repeating the moving and returning steps.

2. The process for using an exercise device of claim 1, wherein the starting position comprises the user being on hands and knees on a flat surface.

3. The process for using an exercise device of claim 2, wherein the finishing position comprises the user raising the second bodily appendage away from the flat surface in line with the user's torso and extending the foot of the second bodily appendage toward a ceiling.

4. The process for using an exercise device of claim 1, wherein the starting position comprises the user being on hands and knees on a flat surface.

5. The process for using an exercise device of claim 4, wherein the finishing position comprises the user raising the second bodily appendage away from the flat surface lateral to the user's torso and keeping the knee of the second bodily appendage bent.

6. The process for using an exercise device of claim 1, wherein the starting position comprises the user being seated on a chair or bench.

7. The process for using an exercise device of claim 6, wherein the finishing position comprises the user standing in front of the chair or bench with the first bodily appendage raised with a hip and knee bent at ninety degree angles.

8. The process for using an exercise device of claim 1, wherein the starting position comprises the user laying prone, face-up on a flat surface with knees raised and bent at ninety degree angles.

9. The process for using an exercise device of claim 8, wherein the finishing position comprises the user keeping the first leg raised and bent at ninety degrees and extending the second leg straight in-line with a torso and the foot lowered toward the flat surface.

* * * * *